US005978993A

United States Patent [19]

Rivera

[11] Patent Number: 5,978,993

[45] Date of Patent: Nov. 9, 1999

[54] FOLDING MULTI-PURPOSE TOOL WITH COMFORTABLE HANDLES

[75] Inventor: Benjamin C. Rivera, West Linn, Oreg.

[73] Assignee: Leatherman Tool Group, Inc.

[21] Appl. No.: 08/751,232

[22] Filed: Nov. 18, 1996

[51] Int. Cl.[6] ..... B25B 7/22; B26B 13/00

[52] U.S. Cl. ..... 7/128; 7/129; 81/427.5; 30/153; 30/155; 30/255

[58] Field of Search ..... 7/127–135, 158; 81/427.5, 177.6, 177.4; 30/162, 142, 131, 151–153, 155, 252–255

[56] References Cited

U.S. PATENT DOCUMENTS

| | | | |
|---|---|---|---|
| 337,858 | 3/1886 | Neuhaus . | |
| 1,174,132 | 3/1916 | Dragun . | |
| 1,334,425 | 3/1920 | Wernimont . | |
| 1,362,142 | 12/1920 | Rohrer . | |
| 1,362,143 | 12/1920 | Rohrer . | |
| 1,370,906 | 3/1921 | Newton . | |
| 2,431,970 | 12/1947 | Swartz | 30/186 |
| 2,575,652 | 11/1951 | Bovee | 81/43 |
| 3,568,315 | 3/1971 | Smith | 30/161 |
| 4,238,862 | 12/1980 | Leatherman | 7/128 |
| 4,302,877 | 12/1981 | Hart et al. | 30/161 |
| 4,669,140 | 6/1987 | Miceli . | |
| 4,703,560 | 11/1987 | Brooker | 30/155 |
| 4,741,106 | 5/1988 | Yamagishi | 30/161 |
| 4,744,272 | 5/1988 | Leatherman | 81/427.5 |
| 4,942,637 | 7/1990 | Yeang-Yai . | |
| 5,062,173 | 11/1991 | Collins . | |
| 5,142,721 | 9/1992 | Sessions | 7/128 |
| 5,212,844 | 5/1993 | Sessions | 7/128 |
| 5,267,366 | 12/1993 | Frazer | 7/128 |
| 5,491,856 | 2/1996 | Legg | 7/128 |
| 5,689,886 | 11/1997 | Yeh | 7/129 X |
| 5,697,114 | 12/1997 | McIntosh et al. | 7/129 |

FOREIGN PATENT DOCUMENTS

| | | | |
|---|---|---|---|
| 179077 | 11/1906 | Germany | 30/255 |
| WO 98/18599 | 5/1998 | WIPO . | |

OTHER PUBLICATIONS

Cooper Industries, Inc. "Falls 1996 New Products Advertising Leaflet"—See Toolzall Pro., Aug. 1996.
SOG "Paratool"Multipurpose Tool—1993.

*Primary Examiner*—D. S. Meislin
*Attorney, Agent, or Firm*—Chernoff, Vilhauer, McClung & Stenzel, LLP

[57] ABSTRACT

A multipurpose folding tool including a pair of pivoted scissors blades or pliers jaws, each having a handle in the form of a channel, attached through a pivot joint permitting the handles to fold around the scissors blades or pliers jaws. Each handle includes a pair of parallel legs, separated by a deep notch defined in the base of the channel forming the handle. Parts of the scissors blades or pliers jaws pass through the notch as the handles are folded, and the channel base faces outward when the handles are extended for use of the scissors or pliers. Other blades are stowed inside the handles and have back surfaces which are coplanar, giving the tool a generally smooth overall configuration when it is folded.

5 Claims, 6 Drawing Sheets

FOLDING MULTI-PURPOSE TOOL WITH COMFORTABLE HANDLES

BACKGROUND OF THE INVENTION

The present invention relates to multipurpose folding hand tools, and particularly to such a tool including pliers or scissors whose handles fold around their jaws or blades.

Many types of multipurpose pocket tools are known in which various knife blades, screwdrivers, or other tool bits fold into storage locations within either of a pair of handles, while each jaw of a pair of pliers or blade of a pair of scissors is also connected to a respective one of the handles. In some such tools the handles are configured as channels of formed sheet metal that are able to pivot around the bases of the pliers jaws, to reduce the size of the tool so that it can be carried in a person's pockets and presents the outside of the channel-shaped handles as the outer surface of the folded tool. Such a tool is disclosed, for example, in. Leatherman U.S. Pat. No. 4,238,862.

Use of a knife blade, screwdriver or other tool bit of such a tool requires that the handles first be spread apart from each other, and, after a selected blade is unfolded from its storage position within one of the channel-shaped handles, the handles are held together while the tool bit is used. Use of the pliers in such a tool requires simply that the handles be unfolded, that is, pivoted outward from their folded positions with respect to the pliers jaws, but this leaves the edges of the channel sides of the handles facing outward, so that squeezing the handles to grip an object between the pliers jaws requires force to be exerted directly against the edges of the channel sides. Since this may be uncomfortable, it is desired to provide a tool having similar capabilities but having the smooth outer surface of the channel base of each handle oriented outward to be contacted in squeezing the pliers handles together to grip an object in the pliers jaws. At the same time it is still desired to be able to fold the handles easily about the pliers jaws to reduce the overall size of the tool when the pliers are not in use. It is also desired to be able to select and unfold one of the knife blades, screwdrivers, or other tool bits from its storage position in one of the handles without then having to manipulate the handles before using the blade, and it is desired for the multi-purpose tool to be compact, present a pleasing appearance and have a shape that is unlikely to cause rapid wear of a pocket in which the folded tool is carried.

SUMMARY OF THE INVENTION

The present invention overcomes the aforementioned shortcomings of the prior art multi-purpose folding tools by providing a multi-purpose folding tool with handles of sheet metal each in the general form of a channel having a base and a pair of channel sides. A slot or deep notch is defined in the base portion of the channel at a first end of each handle, where the base of a pliers jaw or scissors blade is attached to each handle. When the handles are in an extended position, as in the operational configuration of the pliers or scissors, the channel base portion of each handle faces outward. A person squeezing the handles together to close the pliers jaws or scissors blades thus presses against the smooth outer surface of the channel base of the handles, rather than against the edges of the channel sides, and use of the tool is thus comfortable.

The deep narrow notch, or slot, defined at least partly by the channel base portion of the handle, divides the handle near its first end, to define a pair of parallel legs each including one of the channel sides at that end of each handle.

Portions of the scissors blades or pliers jaws can pass into or through the notch between the parallel legs during the process of folding or unfolding the handles with respect to those blades or jaws.

In one embodiment of the invention, a flange adjacent the first end of the handle extends laterally inward from an edge of at least one channel side of the handle. An outer end of the flange acts as an abutment against which the base of the scissors blade or pliers jaw is brought to bear, to limit the angular movement of the handle about the base of the scissors blade or pliers jaw, and the flange also adds stiffness to the channel side.

In one embodiment of the invention, one or more knife blades or tool bits are mounted for pivotal movement about a pivot axis extending between the channel sides at a second end of each handle, so that the blades or tool bits can be pivoted between a stowed position within the channel-shaped handle and an extended, operative position in which a chosen blade or tool bit extends away from the handle.

In a preferred embodiment of the invention all of the knife blades or other tool bits associated with one of the handles include substantially flat back surfaces that all fall in the same plane when the blades or tool bits are stowed in the respective one of the handles. As a result, such a multi-purpose tool, when folded, has a generally rectangular outer shape defined primarily by the channel sides of the handles and by the back surfaces of the blades and tool bits.

In one embodiment of the invention, the base of each of the knife blades or other tool bits includes cam surfaces, and the handles include springs which act upon the cam surfaces to retain the knife blades or other tool bits in either their respective stowed positions or their fully-extended positions.

The foregoing and other objectives, features, and advantages of the invention will be more readily understood upon consideration of the following detailed description of the invention, taken in conjunction with the accompanying drawings.

DETAILED DESCRIPTION OF THE INVENTION

Figure 1:
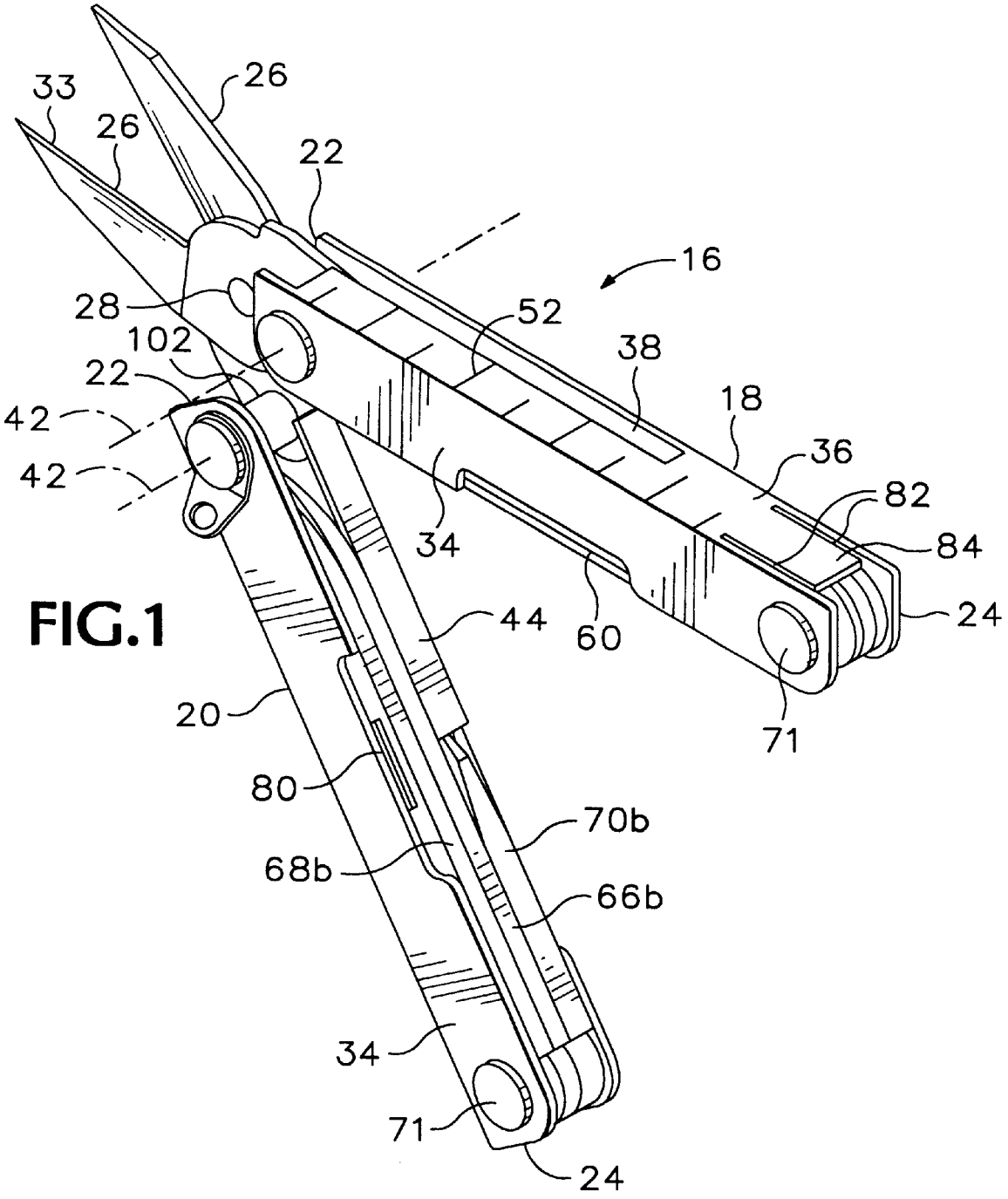
FIG. 1 is a perspective view of a multipurpose folding tool according to the present invention, with a pair of scissors ready for use while other blades and tool bits of the tool are stowed within the handles.
Figure 2:
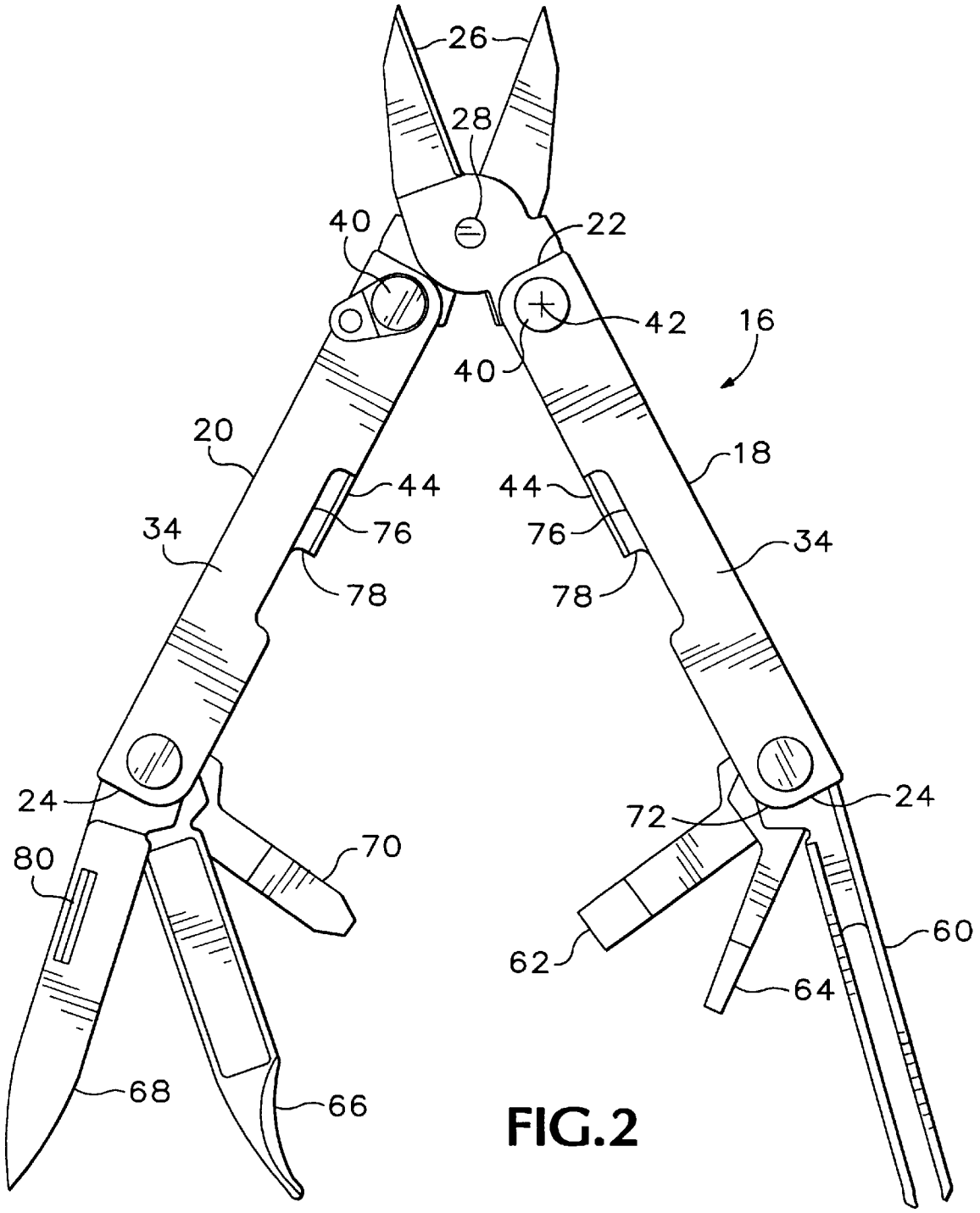
FIG. 2 is a side elevational view of the multipurpose tool shown in FIG. 1, showing each of the several tool bits and blades thereof.

Referring now to FIGS. 1–6 of the drawings which form a part of the disclosure herein, a multi-purpose folding tool 16 embodying the present invention includes a pair of handles 18, 20 each having a pair of opposite first ends 22 and second ends 24, and a pair of tool blades in the form of scissors blades 26, interconnected with each other pivotally through a pivot joint 28 located between a respective base portion 30 and an outer end or blade 32 of each. Each base portion 30 includes a wire cutter edge 31, and each blade 32 includes a sharp scissors edge 33 although it will be clear that the blades 32 could also be configured as pliers jaws to meet each other while the wire cutter edges 31 could still pass each other in scissors action.

The handles 18 and 20 are formed of sheet steel, such as type 420 stainless steel 0.03 inch thick, cut to shape and bent into the form of a U-shaped channel having a pair of channel sides 34 and a channel base 36. A deep narrow slot or notch 38 is defined in the channel base 36 and extends from the first end 22 of each handle 18, 20, along one of the channel sides 34 so that each handle defines a pair of parallel legs adjacent its first end 22. The handles 18 are mirror images of each other, and the notches 38 are thus aligned with each other.

A pivot pin 40, which may be an internally threaded tubular fastener mated with a screw, extends between and interconnects the channel sides of each of the handles 18 and 20. Each pin 40 extends through a closely-fitting hole defined in the base portion of a respective one of the tool blades, so that each handle 18 and 20 can pivot about a handle folding axis 42 defined by the respective pivot pin 40 with respect to the base portion 30 of one of the scissors blades 26. Small annular or tubular spacers 104 also fit on each pivot pin 40 to separate the scissors blade base 30 from the channel sides 34.

An inwardly directed flange 44 extends along one of the channel sides 34 on the open side or mouth of the channel of each handle 18 and 20, in a location opposite the notch 38 defining the two parallel legs at the first end 22 of each handle. The flange 44 helps to close the scissors blades properly, and functions to exclude dirt and lint from within the handle, as well as contributing to the overall appearance of a unified closed shape of the handles. The flange 44 also provides some stiffening of the channel side 34 of the leg of the handle of which the flange 44 is a part, and thus compensates, in part, for the presence of the notch 38.

Figure 3:
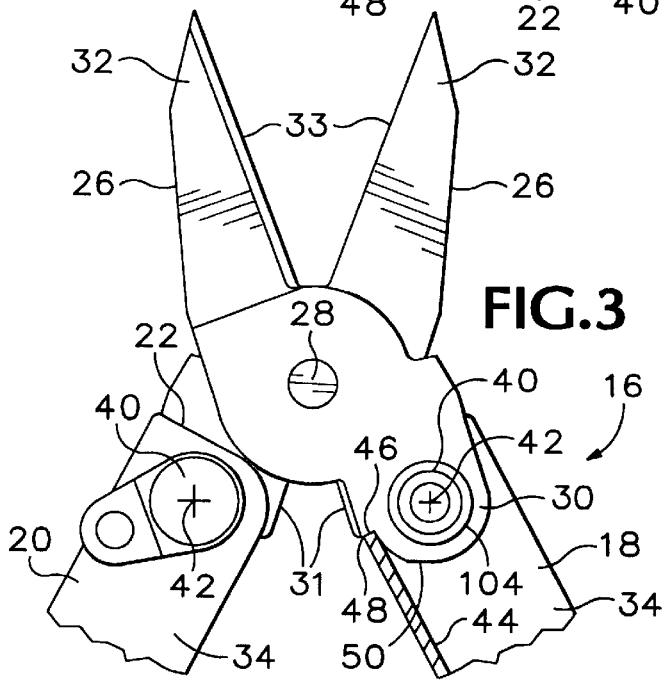
FIG. 3 is a partially cutaway detail view, at an enlarged scale, showing the pivot joint of the scissors blades and also showing a wire cutter portion of the tool shown in FIG. 2.
Figure 5:
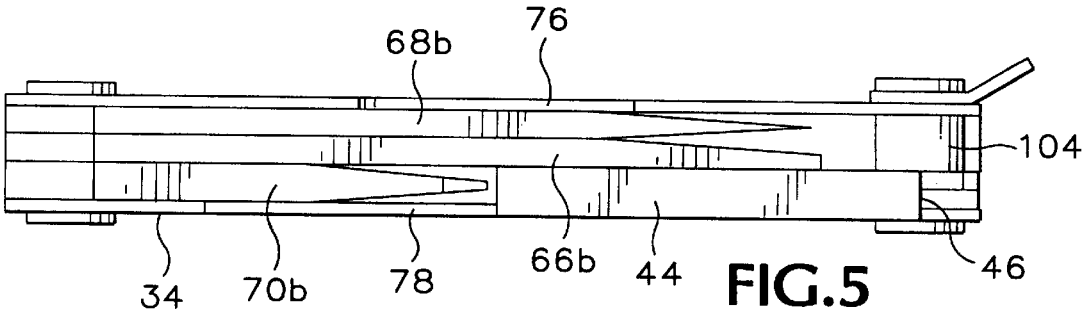
FIG. 5 is a top view of the multipurpose tool shown in FIG. 1 in its completely folded configuration.
Figure 6:
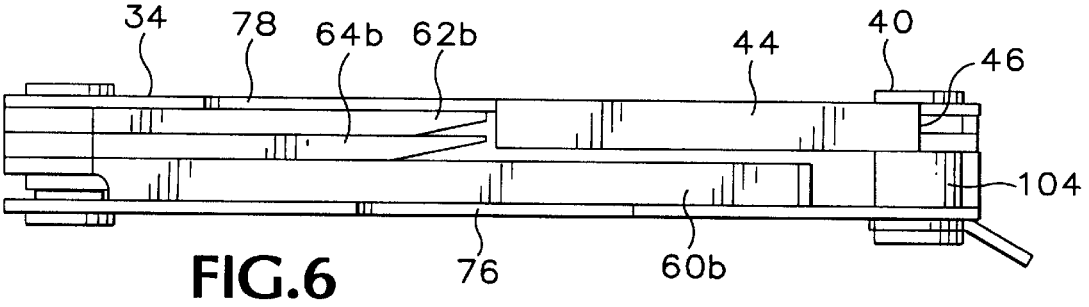
FIG. 6 is a bottom view of the tool shown in FIG. 1 in its completely folded configuration.

An outer end 46 of the flange 44, located adjacent to the first end 22 of each handle 18, 20 acts as an abutment to support a correspondingly-located shoulder 48 defined on the base portion 30 of each of the scissors blades 26 to limit the rotational movement of the respective handle in a blade-extending direction about each scissors blade, so that further movement of the handles will result in movement of the scissors blades 26 with respect to each other about the pivot joint 28 to cut a workpiece. Preferably, as shown in FIG. 3, a cam lobe 50 defined on the base 30 of each scissors blade 26 presses against the respective flange 44 with a small amount of interference, moving the flange 44 a small distance elastically to bind each scissors blade 26 frictionally relative to the respective handle 18 or 20 and thus to keep the end 46 of each flange 44 snugly in place against the respective shoulder 48.

Each of the handles 18 and 20 can be rotated with respect to the base portion 30 of the respective one of the scissors blades about the axis of the pivot pin 40, to a position (not shown) in which the first ends 22 of the handles 18, 20 may be abutted against each other, with the handles 18, 20 extending in a straight line in opposite directions, so that a measuring scale 52 inscribed on the outside of the channel bases 36 is available for use to measure distances as great as the combined lengths of the handles 18 and 20.

Figure 4:
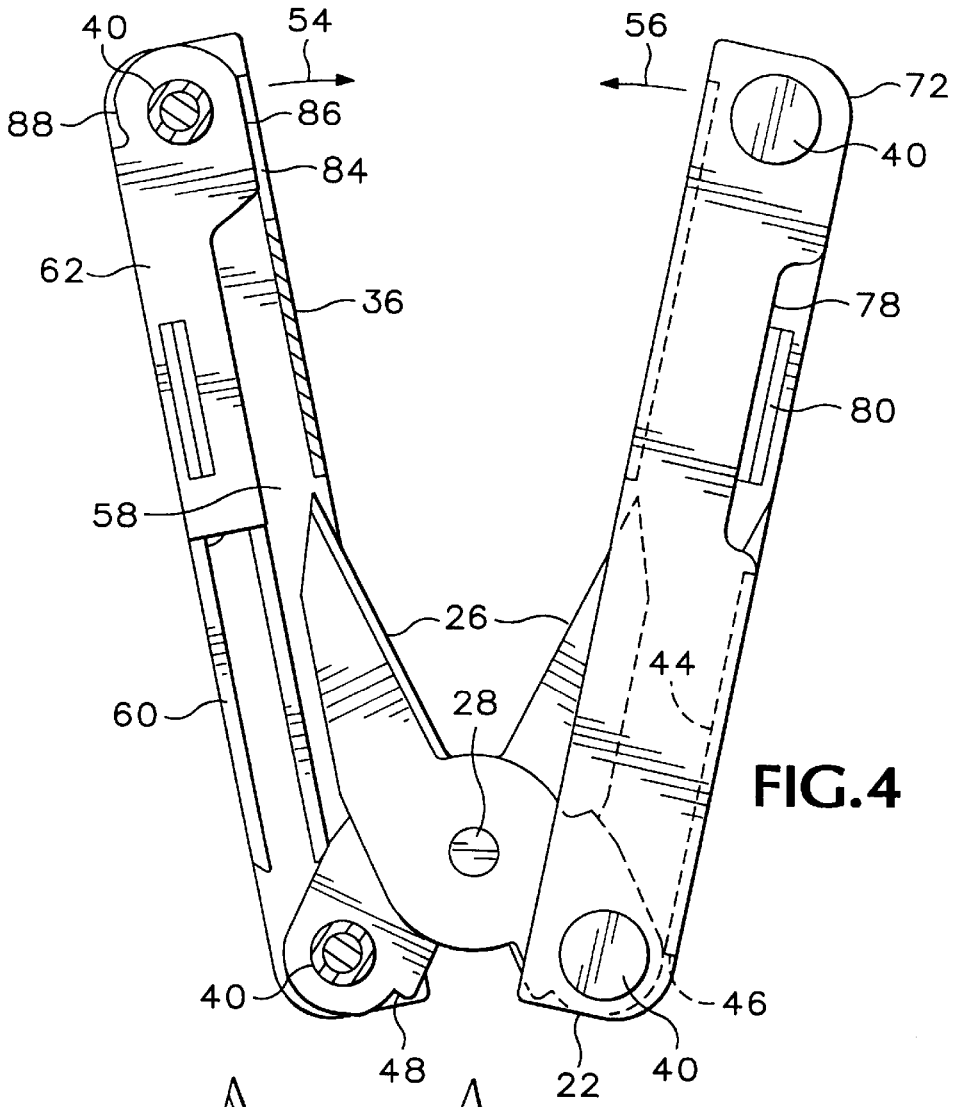
FIG. 4 is a partially cutaway side elevational view of the tool shown in FIG. 1, with the handles in a partially folded position with respect to the scissors blades.

When the handles 18, 20 are rotated further about the pivot axes defined by the pivot pins 40 in the direction of the arrows 54, 56 as shown in FIG. 4, a portion of the pivot joint 28 and the outer, or blade end 32, of each scissors blade 26 moves through the deep notch 38 into an interior space 58 defined within the one of the handles 18, 20 opposite the one to which its respective base portion 30 is attached. The flanges 44 keep the outer ends 32 of the scissors blade from passing through the handles 18 and 20 and out the otherwise open side, or mouth, of the channel.

At the second end 24 of each of the handles 18, 20 are a plurality of blades or tool bits, including a pair of tweezers 60, a medium screwdriver 62, and a very narrow screwdriver 64 in the first handle 18, and a nail file and fingernail cleaner 66, a pen knife blade 68, and a flat, modified Phillips screwdriver blade 70 in the second handle 20, all fitted on a respective pivot pin 71 in each handle 18, 21. The respective back surfaces 60*b*, 62*b*, 64*b*, 66*b*, 68*b*, and 70*b* of the tool bits and blades are generally planar, and when the tool 16 is fully folded these surfaces are substantially coplanar with each other and with the respective flange 44 in each of the handles 18, 20, so that the overall shape of the fully folded tool 16 is generally rectangular, with discontinuous but generally flat outer sides made up of a flange 44 and the respective ones of the back surfaces 60*b*, 62*b*, 64*b*, 66*b*, 68*b* and 70*b*. The channel sides have rounded corners 72, and the exterior surfaces of the handles, where the channel sides 34 meet the channel base 36, are rounded so that the tool can be carried safely in one's pocket without causing rapid or excessive wear of the pocket fabric.

Tool access notches 76 and 78 are defined, respectively, in the channel sides 34 of each of the handles, to give access to fingernail grooves 80 in the individual tool bits and blades.

Figure 7:
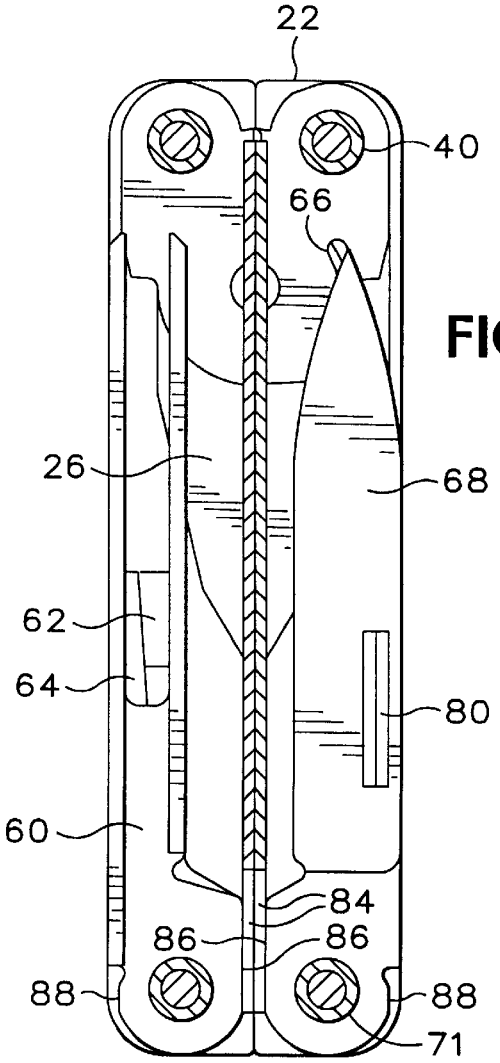
FIG. 7 is a partially cutaway side elevational view of the multipurpose tool shown in FIG. 1 in its completely folded configuration.

A pair of narrow slits 82 are defined in the channel base near the second end of each handle 18, 20 to define a cantilevered spring 84. The spring 84 is bent slightly inward before assembly of the several tool bits into place within the channel, and thus extends at a slight angle toward the interior of the space 58 defined within the channel shape of the respective handle. The spring 84 acts as a cam follower, pressing against respective cam surfaces 86 defined on the base of each of the several tool bits 60, 62, 64, 66, 68, and 70, to keep them in their stowed positions when the multipurpose tool 16 is fully folded, as shown in FIG. 7.

Figure 8:
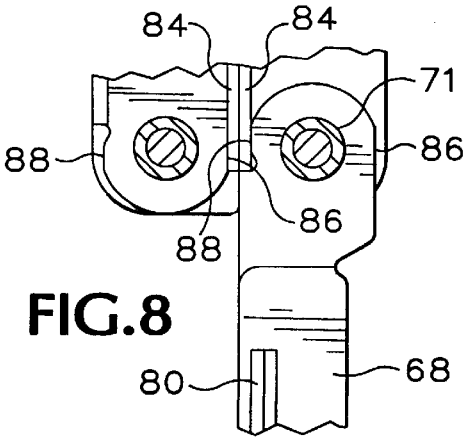
FIG. 8 is a partially cutaway side elevational view of a portion of the multi-purpose tool shown in FIG. 1, with one of the knife blades extended.
Figure 9:
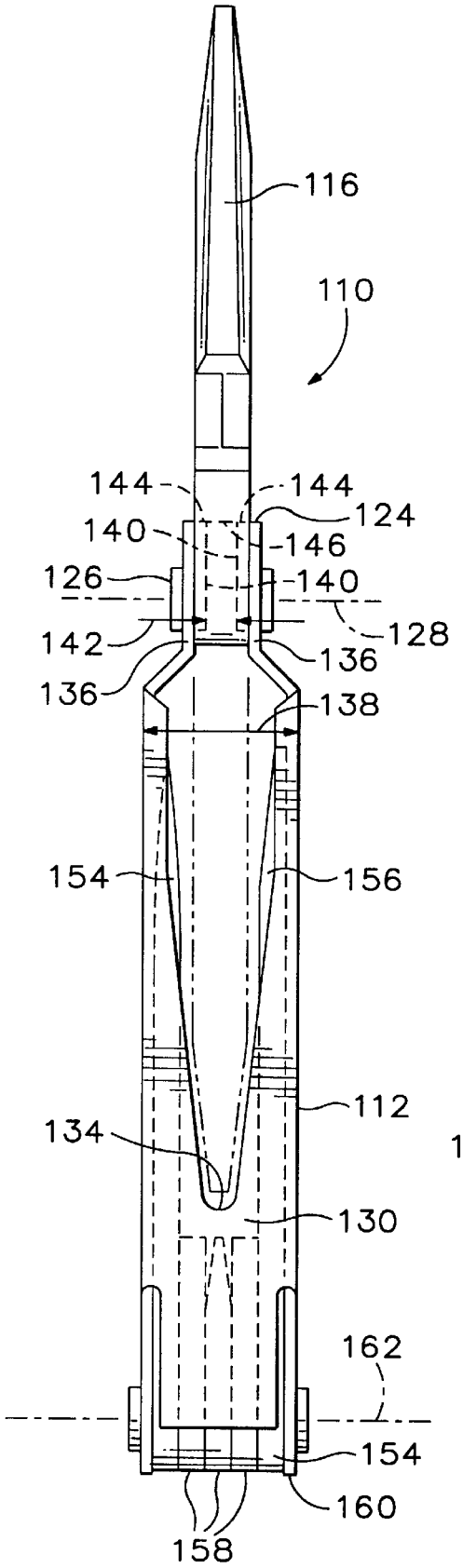
FIG. 9 is a top view of a multipurpose tool according to the present invention, showing a pair of pliers ready for use.
Figure 10:
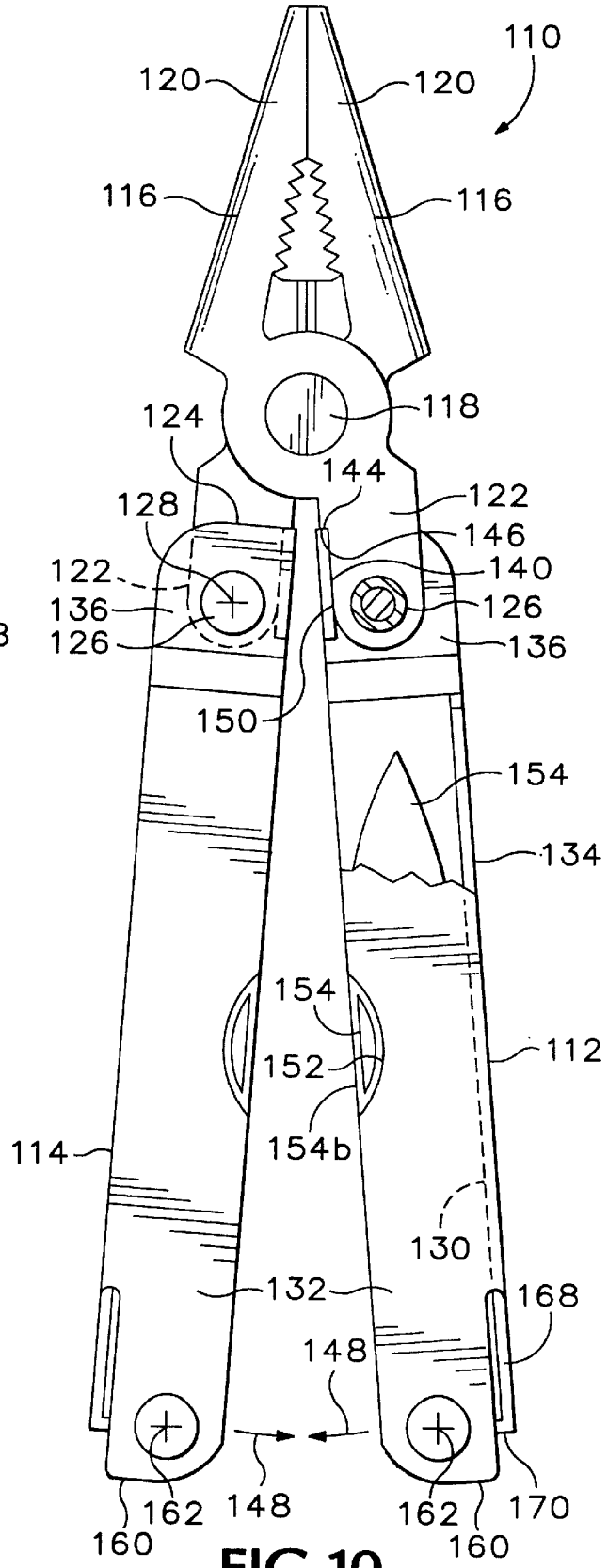
FIG. 10 is a partially cutaway side elevational view of the tool shown in FIG. 9.

The spring 84 also bears against a cam surface 88 on the opposite side of the base of each of the individual blades and tool bits to hold a selected blade or bit in an extended position for use thereof, as shown in FIG. 8.

Referring now to FIGS. 9–12 a folding multipurpose tool 110 which is another embodiment of the invention also includes a pair of channel-shaped handles 112, 114 formed of sheet steel, and a pair of tool blades in the form of pliers jaws 116, pivotally interconnected with each other at a pivot joint 118 and having outer or jaw ends 120 and base portions 122. Each base portion 122 is connected to a first end 124 of one of the pair of handles 112, 114 by a pivot pin 126 defining a respective pivot axis 128 so that each handle 112, 114 can be rotated about the base portion 122 of the respective pliers jaw 116.

Each of the handles 112, 114 includes a channel base 130 and a pair of channel sides 132. At the first end 124 of each handle, a deep notch 134 is defined in the channel base 130. An end portion 136 of each channel side 132 is offset inwardly toward the opposite side 132 so that the end portions 136 are closer together than the width 138 of the rest of the channel, to locate the jaws 116 centrally of each handle 112, 114.

A flange 140 extends laterally inwardly from the margin of each of the channel sides 132, on the back of the handle, opposite the channel base 130, in the end portions 136, leaving a relatively small space 142 between the inner margins of the flanges. Each flange 140 has an outer end 144, and the base 122 of each of the pliers jaws 116 has a shoulder 146 which abuts against the outer ends 144 of the flanges when the handles 112, 114 are unfolded, limiting movement of the handle 112 or 114 with respect to the base portion 122 of the pliers jaw 116 in the direction of the arrows 148, so that further movement of the handles 112 and 114 in the direction of the arrows 148 can be accomplished only by swinging the pliers jaw outer ends 120 toward each other about the pivot joint 118.

When the outer ends 144 of the flanges 140 abut against the shoulders 146 of the pivotally interconnected pliers jaws 116, with the pliers in their operative configuration, the channel bases 130 form the outer sides of the handles 112 so that the user has available the smooth outer surfaces of the channel bases 130, to be gripped and squeezed with greater comfort than would be the case were the narrow edges of the channel sides 132 oriented outward. Preferably, the base 122 of each jaw 116 has an appropriate shape including a slight protrusion at 150 to provide an interference fit requiring a slight elastic movement of each flange 140, to keep the handles 112, 114 snugly in place relative to the bases 122, with the flange outer ends 144 abutted against the shoulders 146.

Each channel side 132 defines a shallow tool bit access notch 152, and a plurality of blades 154, 156 and tool bits 158 may be provided at a second end 160 of each of the handles, where each blade or tool bit is rotatable about an axis 162 defined by a respective tool blade pivot pin 164. Each of the blades 154, 156 and tool bits 158 includes a notch 166, and a spring 168 includes a catch 170 to engage the notch 166 to hold a selected blade or tool bit in an extended position.

The number of blades or tool bits which can be included in the handles 112, 114 is limited by the width 138. The various blades and tool bits must be located in the handles 112, 114 in a way that leaves clearance for the outer ends 120 of the pliers jaws 116 as the handles 112, 114 are pivoted about the respective axes 128 in folding or unfolding the tool.

Figure 12:
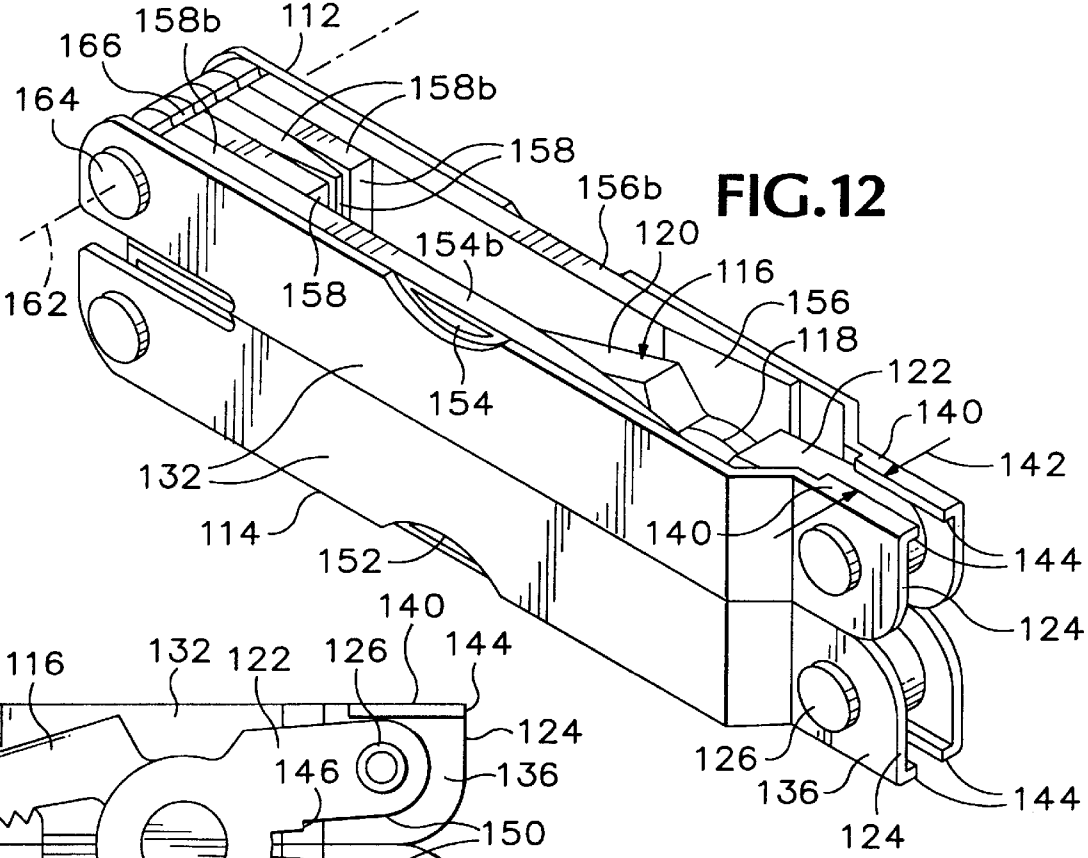
FIG. 12 is a perspective view of the multipurpose tool shown in FIGS. 9–11 in a completely folded configuration.
Figure 11:
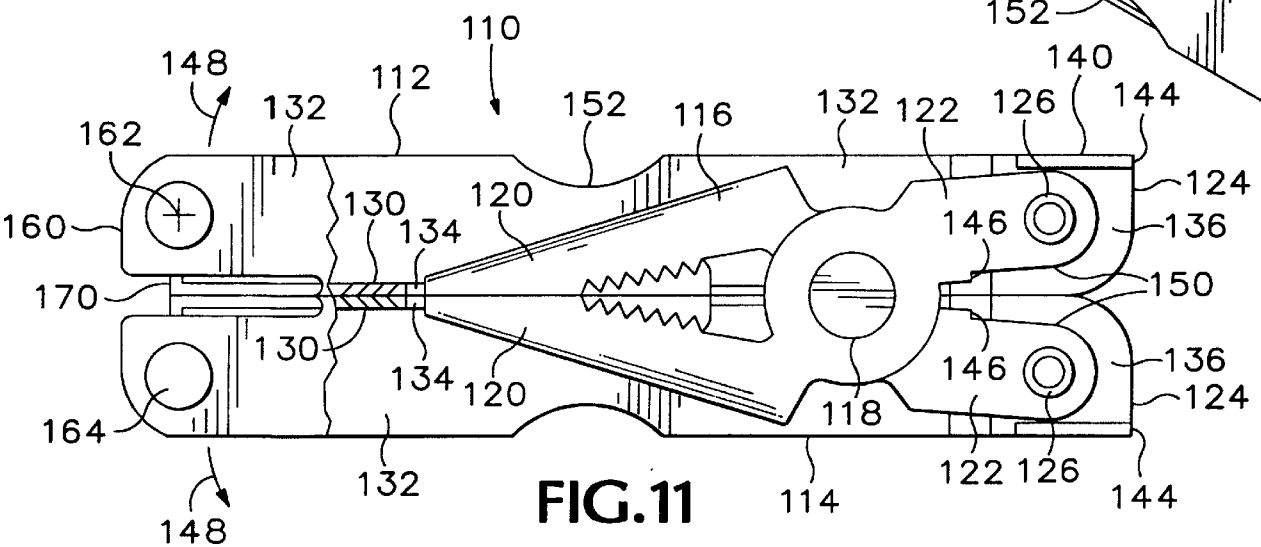
FIG. 11 is a partially cutaway side elevational view of the multipurpose tool shown in FIGS. 9 and 10, in a completely folded configuration.

As with the folding multipurpose tool 16, each of the several blades 154, 156 and tool bits 158 preferably includes a substantially planar back surface 154*b*, 156*b*, or 158*b*, and all of the back surfaces are preferably aligned generally coplanar with each other when the tool 110 is fully folded, as shown in FIGS. 11 and 12 to give the folded tool a regular overall shape.

The terms and expressions which have been employed in the foregoing specification are used therein as terms of description and not of limitation, and there is no intention, in the use of such terms and expressions, of excluding equivalents of the features shown and described or portions thereof, it being recognized that the scope of the invention is defined and limited only by the claims which follow.

I claim:

1. A folding tool, comprising:

(a) a pair of handles, each said handle having a pair of opposite first and second ends, a portion of each said handle being of channel shape and including a channel base and a pair of channel sides and said first end of each said handle including a pair of parallel legs, said parallel legs being defined at least partially by a deep notch in the respective channel base adjacent said first end of the respective handle;

(b) a pair of pivotally interconnected tool blades each having a base portion and an outer end;

(c) a pivot joint located between said base portion and said outer end of each of said pair of tool blades and pivotally interconnecting said pair of tool blades;

(d) a respective pivot pin located in each of said handles adjacent said first end and extending between said parallel legs thereof, each said pivot pin pivotally connecting one of said handles to said base portion of a respective one of said pair of pivotally interconnected tool blades and defining a handle folding axis, and each said handle being movable about a respective one of said handle folding axes, with respect to said respective one of said pair of tool blades, between:

(i) a folded position in which said respective one of said pair of pivotally interconnected tool blades is located with said outer end located alongside and extending generally parallel with said handle, with a portion of said pivot joint located within said handle and with both of said tool blades housed between said parallel legs of said pair of handles, and (ii) an operational position in which each said tool blade extends away from and generally in line with the respective one of said pair of handles that is connected to said base portion of said tool blade, with said pair of tool blades pivotally movable with respect to each other, and with said channel bases of said handles facing outwardly away from each other when said outer ends are aligned generally adjacent each other; and (e) a respective pivot pin associated with said second end of at least one of said handles, and at least one folding tool bit pivotally movable about said pivot pin, between a folded position within said handle and an extended position, each said folding tool bit including a base having a cam surface, and said handle including a cam follower elastically biased toward said cam surface, wherein said base of said tool bit includes a notch and said cam follower includes a catch located so as to engage said notch when said tool bit is in a predetermined position with respect to said handle.

2. A folding tool, comprising:

(a) a pair of handles, each said handle having a pair of opposite first and second ends, a portion of each said handle being of channel shape and including a channel base and a pair of channel sides and said first end of each said handle including a pair of parallel legs, said parallel legs being defined at least partially by a deep notch in the respective channel base adjacent said first end of the respective handle, at least one of said handles including an inwardly-directed flange extending along one of said channel sides, oriented generally parallel with said channel base and spaced apart therefrom;

(b) a pair of pivotally interconnected tool blades each having a base portion and an outer end;

(c) a pivot joint located between said base portion and said outer end of each of said pair of tool blades and pivotally interconnecting said pair of tool blades; and (d) a respective pivot pin located in each of said handles adjacent said first end and extending between said parallel legs thereof, each said pivot pin pivotally connecting one of said handles to said base portion of a respective one of said pair of pivotally interconnected tool blades and defining a handle folding axis, and each said handle being movable about a respective one of said handle folding axes, with respect to said respective one of said pair of tool blades, between:

(i) a folded position in which said respective one of said pair of pivotally interconnected tool blades is located with said outer end located alongside and extending generally parallel with said handle, with a portion of said pivot joint located within said handle and with both of said tool blades housed between said parallel legs of said pair of handles, and (ii) an operational position in which each said tool blade extends away from and generally in line with the respective one of said pair of handles that is connected to said base portion of said tool blade, with said pair of tool blades pivotally movable with respect to each other, and with said channel bases of said handles facing outwardly away from each other when said outer ends are aligned generally adjacent each other.

3. A folding tool, comprising:

(a) a pair of handles, each said handle having a pair of opposite first and second ends, a portion of each said handle being of channel shape and including a channel base and a pair of channel sides and said first end of each said handle including a pair of parallel legs, said parallel legs being defined at least partially by a deep notch in the respective channel base adjacent said first end of the respective handle;

(b) a pair of pivotally interconnected scissors blades each having a base portion and an outer end;

(c) a pivot joint located between said base portion and said outer end of each of said pair of scissors blades and pivotally interconnecting said pair of scissors blades; and (d) a respective pivot pin located in each of said handles adjacent said first end and extending between said parallel legs thereof, each said pivot pin pivotally connecting one of said handles to said base portion of a respective one of said pair of pivotally interconnected scissors blades and defining a handle folding axis, and each said handle being movable about a respective one of said handle folding axes, with respect to said respective one of said pair of scissors blades, between:

(i) a folded position in which said respective one of said pair of pivotally interconnected scissors blades is located with said outer end located alongside and extending generally parallel with said handle, with a portion of said pivot joint located within said handle and with both of said scissors blades housed between said parallel legs of said pair of handles, and (ii) an operational position in which each said scissors blade extends away from and generally in line with the respective one of said pair of handles that is connected to said base portion of said scissors blade, with said pair of scissors blades pivotally movable with respect to each other, and with said channel bases of said handles facing outwardly away from each other when said outer ends are aligned generally alongside one another.

4. A folding tool, comprising:

(a) a pair of handles, each handle having a pair of opposite first and second ends, said first end including a pair of parallel legs, a portion of each handle being of channel shape and including a channel base and a pair of channel sides;

(b) a pair of pivotally interconnected tool blades each having a base portion and an outer end;

(c) a pivot joint located between said base portion and said outer end of each of said pair of tool blades and pivotally interconnecting said pair of tool blades, said tool blades also including a pair of wire cutter edges each located between said pivot joint and said first end of a respective one of said handles; and (d) a respective pivot pin located in each of said handles adjacent said first end and extending between said parallel legs thereof, each said pivot pin pivotally connecting one of said handles to said base portion of a respective one of said pair of pivotally interconnected tool blades and defining a handle folding axis, and each said handle being movable about a respective one of said handle folding axes, with respect to said respective one of said pair of tool blades, between:

(i) a folded position in which said respective one of said pair of pivotally interconnected tool blades is located with said outer end located alongside and extending generally parallel with said handle, with a portion of said pivot joint located within said handle and with both of said tool blades housed between said parallel leas of said pair of handles, and (ii) an operational position in which each said tool blade extends away from and generally in line with the respective one of said pair of handles that is connected to said base portion of said tool blade, with said pair of tool blades pivotally movable with respect to each other, and with said channel bases of said handles facing outwardly away from each other when said outer ends are aligned generally adjacent each other.

5. A folding tool, comprising:

(a) a pair of handles, each handle having a pair of opposite first and second ends, said first end including a pair of parallel legs, a portion of each handle being of channel shade and including a channel base and a pair of channel sides;

(b) a pair of pivotally interconnected pliers jaws each having a base portion and an outer end, said pliers jaws including a pair of wire cutter edges located on said base portions thereof;

(c) a pivot joint located between said base portion and said outer end of each of said pair of pliers jaws and pivotally interconnecting said pair of pliers jaws; and (d) a respective pivot gin located in each of said handles adjacent said first end and extending between said parallel leas thereof, each said pivot pin pivotally connecting one of said handles to said base portion of a respective one of said pair of pivotally interconnected pliers jaws and defining a handle folding axis, and each said handle being movable about a respective one of said handle folding axes, with respect to said respective one of said pair of pliers jaws, between:

(i) a folded position in which said respective one of said pair of pivotally interconnected pliers laws is located with said outer end located alongside and extending generally parallel with said handle, with a portion of said pivot joint located within said handle and with both of said pliers jaws housed between said parallel leas of said pair of handles, and (ii) an operational position in which each said pliers jaw extends away from and generally in line with the respective one of said pair of handles that is connected to said base portion of said pliers jaw, with said pair of pliers jaws pivotally movable with respect to each other, and with said channel bases of said handles facing outwardly away from each other when said outer ends are aligned generally adjacent each other.

* * * * *

UNITED STATES PATENT AND TRADEMARK OFFICE

CERTIFICATE OF CORRECTION

PATENT NO. : 5,978,993
APPLICATION NO. : 08/751232
DATED : November 9, 1999
INVENTOR(S) : Benjamin C. Rivera et al.

It is certified that error appears in the above-identified patent and that said Letters Patent is hereby corrected as shown below:

In Column 8, Line 39, “leas” should read --legs--.

In Column 8, Line 53, “shade” should read --shape--.

In Column 8, Line 63, “gin” should read --pin--.

In Column 8, Line 65, “leas” should read --legs--.

In Column 9, Line 6, “laws” should read --jaws--.

In Column 9, Line 11, “leas” should read --legs--.

Signed and Sealed this
Nineteenth Day of June, 2012

David J. Kappos
*Director of the United States Patent and Trademark Office*